US011864647B1

(12) United States Patent
Molenda-Schroth

(10) Patent No.: US 11,864,647 B1
(45) Date of Patent: Jan. 9, 2024

(54) TWO-LAYER CORSAGE SLEEVE

(71) Applicant: Michelle April Molenda-Schroth, New London, WI (US)

(72) Inventor: Michelle April Molenda-Schroth, New London, WI (US)

( * ) Notice: Subject to any disclaimer, the term of this patent is extended or adjusted under 35 U.S.C. 154(b) by 0 days.

(21) Appl. No.: 16/502,201

(22) Filed: Jul. 3, 2019

(51) Int. Cl.
*A45F 5/08* (2006.01)
*A44C 5/00* (2006.01)
*A45F 5/00* (2006.01)

(52) U.S. Cl.
CPC ..... *A45F 5/08* (2013.01); *A44C 5/0007* (2013.01); *A45F 2005/008* (2013.01)

(58) Field of Classification Search
CPC ..... A47G 7/044; A44C 5/025; A44C 5/0007; A45D 8/34; G09F 3/16; A45F 5/08; A45F 2005/008
See application file for complete search history.

(56) References Cited

U.S. PATENT DOCUMENTS 2,787,819 A * 4/1957 Kaber ..... A44C 5/0007 24/5
3,279,008 A * 10/1966 Wallach ..... A63C 11/021 D3/18
3,302,258 A 2/1967 Meyer
3,949,568 A 4/1976 Gallagher
D409,522 S 5/1999 Satterfield et al.
5,966,865 A * 10/1999 Jones ..... A47G 7/044 248/218.4
6,001,471 A * 12/1999 Bries ..... C09J 7/26 428/343
6,594,866 B1 7/2003 Croyle
6,701,531 B1 3/2004 Hayden
D541,691 S 5/2007 Fitzgerald
8,424,228 B2 * 4/2013 Toussoun ..... G09F 3/14 40/6
10,485,310 B2 * 11/2019 Harris ..... A44C 5/025
2006/0185234 A1 8/2006 Fitzgerald
2008/0127461 A1 * 6/2008 Linden ..... A45F 5/02 24/302
2009/0056211 A1 * 3/2009 Mirakyan ..... A45F 5/08 47/41.01

(Continued)

*Primary Examiner* — Lee A Holly

(57) ABSTRACT

The present invention is directed to a corsage sleeve comprised of two layers that releasably engage one another. The sleeve is configured to attach an ornamental decoration, such as flowers, to a substrate, typically a band worn by a user of the two-layer sleeve. In one version of my invention, the two-layer sleeve comprises a first layer having two surfaces—a first surface and a second, opposing surface—with the first surface comprising a plurality of loop-like structures. A second layer also comprises two surfaces—a first surface and a second, opposing surface—with the first surface comprising a plurality of hook-like structures configured to releasably engage, interlock, or mate with at least a portion of the loop-like structures of the first surface of the first layer. In use, the first surface of the first layer is pressed against the first surface of the second layer, with a portion of a substrate interposed and sandwiched between (i.e., confined by) the first and second layers. An ornamental decoration is attached to the two-layer sleeve using a fastener (e.g., an adhesive, tape, a magnet, metal, wire, ribbon, string, etc.).

11 Claims, 6 Drawing Sheets

(56) References Cited

U.S. PATENT DOCUMENTS

| | | | | |
|---|---|---|---|---|
| 2016/0157578 | A1* | 6/2016 | Ricci | A45D 8/14<br>132/200 |
| 2018/0168294 | A1* | 6/2018 | Pandolfino | A41D 25/005 |
| 2020/0079549 | A1* | 3/2020 | Prakken | B65D 5/542 |

* cited by examiner

TWO-LAYER CORSAGE SLEEVE

BACKGROUND

Peoples' lives are marked by important celebrations. These celebrations include dances, proms, weddings, balls, receptions, birthdays, festivals, and the like. People attending such celebrations often dress formally. Men, for example, may choose to wear sport coats and slacks, suits, or tuxedos. Women, on the other hand, may wear evening gowns, dresses, or suits. For many such events, the attendees wear a decorative arrangement of flowers—typically corsages for women; boutonnieres for men. Often women wear the decorative flowers on their wrists. Typically a decorative arrangement of flowers may be pinned to a length of ribbon that is tied around the wrist. Or flowers may be glued or magnetically attached to a disposable bracelet. Such approaches work. But there is a need for a corsage, and/or components thereof, that give a manufacturer, seller, or user improved performance and more options when deploying and using a corsage.

SUMMARY

I have invented a two-layer corsage sleeve that may be used by men and women to wear and display ornamental decorations such as natural and/or artificial flowers. The sleeve may be used not only for ornamental decorations worn about the wrist, but also at other locations of the body. The two-layer sleeve is comprised of two layers that releasably engage one another. In one version of my invention, the two-layer sleeve comprises a first layer having two surfaces—a first surface and a second, opposing surface—with the first surface comprising a plurality of loop-like structures. A second layer also comprises two surfaces—a first surface and a second, opposing surface—with the first surface comprising a plurality of hook-like structures configured to releasably engage, interlock, or mate with at least a portion of the loop-like structures of the first surface of the first layer. In use, the first surface of the first layer is pressed against the first surface of the second layer, with a portion of a substrate interposed and sandwiched between (i.e., confined by) the first and second layers. Typically the substrate is a band configured to be worn by a user. It should be understood that my invention encompasses physical structures other than hook-and-loop systems that releasably engage each other (e.g., mushroom-like posts that releasably engage: other mushroom-like posts, hooks, loops, etc.).

The individual layers of my two-layer corsage sleeve may be made from a variety of materials, typically nylon, polyester, vinyl, polyethylene, polypropylene, and the like. Other plastics or polymers may be used. The plastic or polymer of which the sleeve is made may be selected to include one or more colors. Also, at least one of the layers may be printed so that a logo or decorative image appears on a surface of the layer. Furthermore, one or both layers of the two-layer corsage sleeve may be cut to present the outline of a geometric, ornamental, or other shape pleasing to the eye of a viewer of the sleeve.

It should be noted, too, that the two layers of my corsage sleeve may be joined to one another along some portion of each of the two layers. For example, one edge of each of the two layers may be sewn, stitched, fused, adhesively joined, or otherwise attached to one another to form a clam-shell-like structure. The two halves of the clam-shell-like sleeve may be opened—with the attached edges acting as a hinge—so that a portion of the substrate may be positioned between, and thereafter confined by, the two layers after the layers have been pressed together so that the opposing surfaces comprising hooks, loops, or other releasably-engageable structures are joined to one another.

Ornamental flowers or other ornamental decoration may be attached to my inventive two-layer corsage sleeve using, for example, pins, wire, adhesive, magnets, or the like. The inventive sleeve may be configured to include openings in one or both layers of the two layers of which the sleeve is composed. The openings may vary in number and shape (e.g., slits, circles, ellipses, squares, etc.), and may be located at various positions in one or both layers of the sleeve (e.g., directly over the substrate or band; or in any flange-like portion of the sleeve that extends outwardly from the confined and enclosed band—the flange-like portion comprising, at least in part, the portions of the sleeve in which the first layer and the second layer are releasably engaged to one another). Wire, ribbon, string, strand, or other such material may be passed through, wrapped around, or otherwise attached to a portion of the ornamental flowers or other ornamental decoration, with the remaining length of the material being passed through one or more openings in the inventive sleeve.

Alternatively, the sleeve may include a magnet, or a metal to which a magnet is attracted, so that an ornamental flower or other decoration may be attached to the sleeve magnetically. The magnet or metal may vary in number and shape (e.g., circles, squares, rectangles, etc.), and may be located at various positions on or in the sleeve. A magnet or metal that will be magnetically attracted to a magnet or metal in the two-layer sleeve may be attached directly to the ornamental flowers (e.g., using an adhesive, adhesive tape, etc.) or indirectly (e.g., to a small bulb or tube, optionally containing water, into which the stem or stems of ornamental flowers are inserted; it should be noted that a tussy-mussy vase—a vase into which the stem or stems of ornamental flowers are inserted, is typically made of metal, and may be employed so that the vase itself is magnetically attracted to magnetic materials embedded in, or attached to, the sleeve). The magnet or metal attached to the flowers—or tube, bulb, vase etc. containing the flowers—is configured to be magnetically attracted to a metal or magnet embedded in, or attached to, one or both layers of my two-layer corsage sleeve.

Also, ornamental flowers or other decoration may be attached to the sleeve using an adhesive (e.g., an initially liquid adhesive composition that solidifies with time) or adhesive tape. Any conventional fastener, attachment element, or attachment system may be used in conjunction with my two-layer corsage sleeve so long as the ornamental decoration is reasonably securely attached to the sleeve (note, too, that my two-layer corsage sleeve may incorporate more than one attachment element, thereby increasing the options available to a seller or user of the corsage sleeve).

The two-layer corsage sleeve may be incorporated into a kit (i.e., a combination of items to be sold together) that includes a substrate to which the sleeve is attached (e.g., a band configured to adopt an essentially curvilinear form when worn). Such a kit may further include an ornamental decoration, such as artificial or natural flowers, to be attached to the two-layer corsage sleeve. Or the two-layer corsage sleeve may be attached to a user's own band (e.g., a priceless heirloom or keepsake). An advantage of my two-layer corsage sleeve is that the sleeve is not permanently attached to the underlying substrate, thereby permitting use with, for example, bands that a user does not want to deface or mar (as might occur, for example, if ornamental flowers were pinned or adhesively attached directly to the band).

My invention also encompasses methods by which my two-layer corsage sleeve is used. One version of my inventive method includes the steps of: (1) providing a two-layer corsage sleeve, the sleeve comprising: (i) a first layer having a first surface and a second, opposing surface, the first surface of the first layer comprising a plurality of loop-like structures; (ii) a second layer comprising two surfaces—a first surface and a second, opposing surface, the first surface of the second layer comprising a plurality of hook-like structures configured to releasably engage at least a portion of the loop-like structures of the first surface of the first layer; (2) positioning a portion of a substrate between the first surface of the first layer and the first surface of the second layer; (3) releasably engaging at least a portion of the first surface of the first layer to at least a portion of the first surface of the second layer such that the substrate is interposed between, and confined by, said first and second layer; and (4) attaching ornamental flowers to the two-layer corsage sleeve. Note that my inventive method is neither restricted to the aforementioned steps, nor the sequence of these steps.

These and other representative embodiments of the two-layer corsage sleeve, and corresponding methods deploying the two-layer corsage sleeve, are described below.

DRAWINGS

FIG. 1 shows one representative version of the invention.

FIGS. 2A through and including 2F show representative versions of bands that may be employed in the present invention.

Figure 4A:
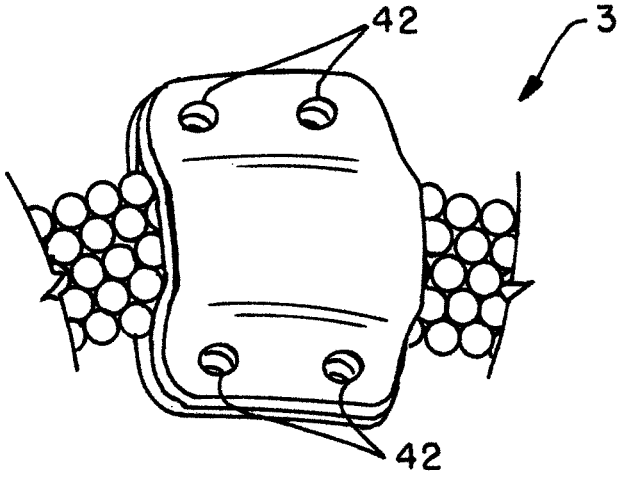

FIGS. 4A through and including 4C show representative versions of the present invention.

Figure 5A:
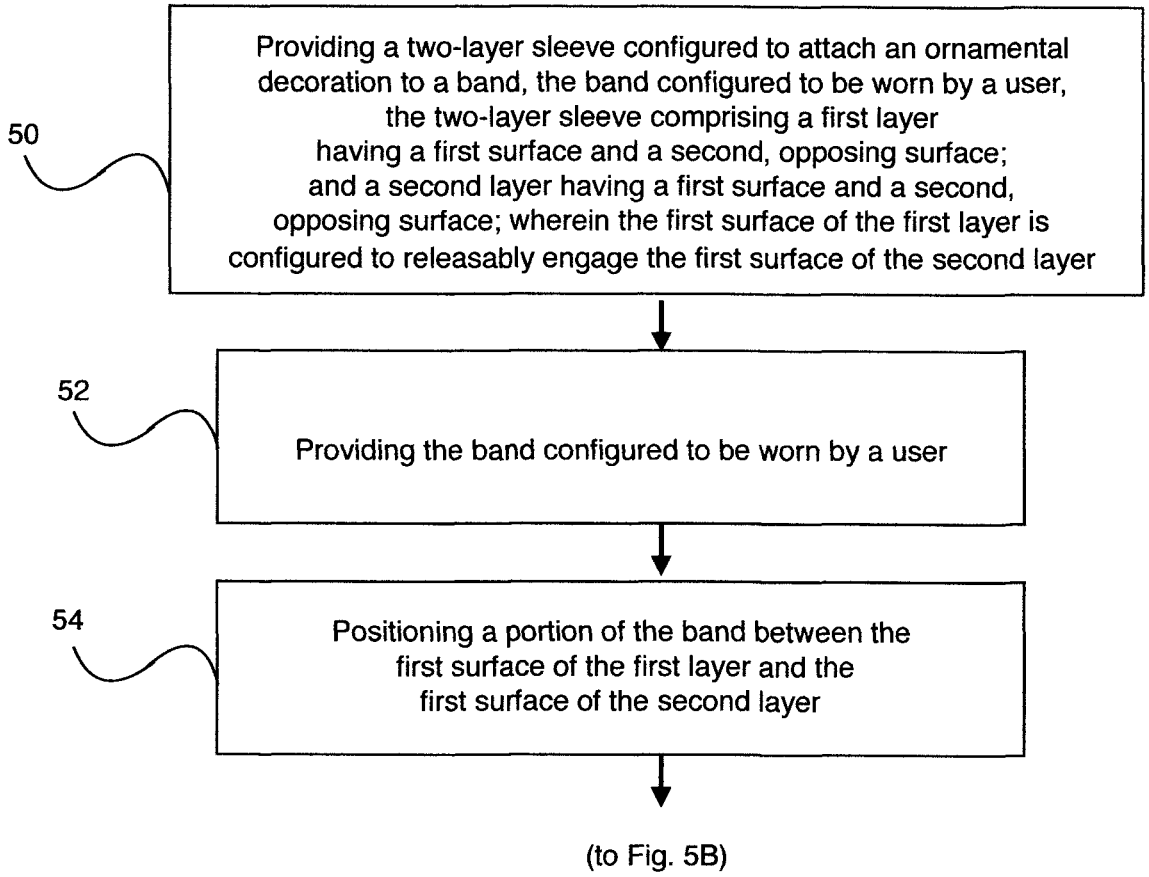

FIGS. 5A and SB show one representative version of a method of the present invention.

DESCRIPTION

Figure 1:
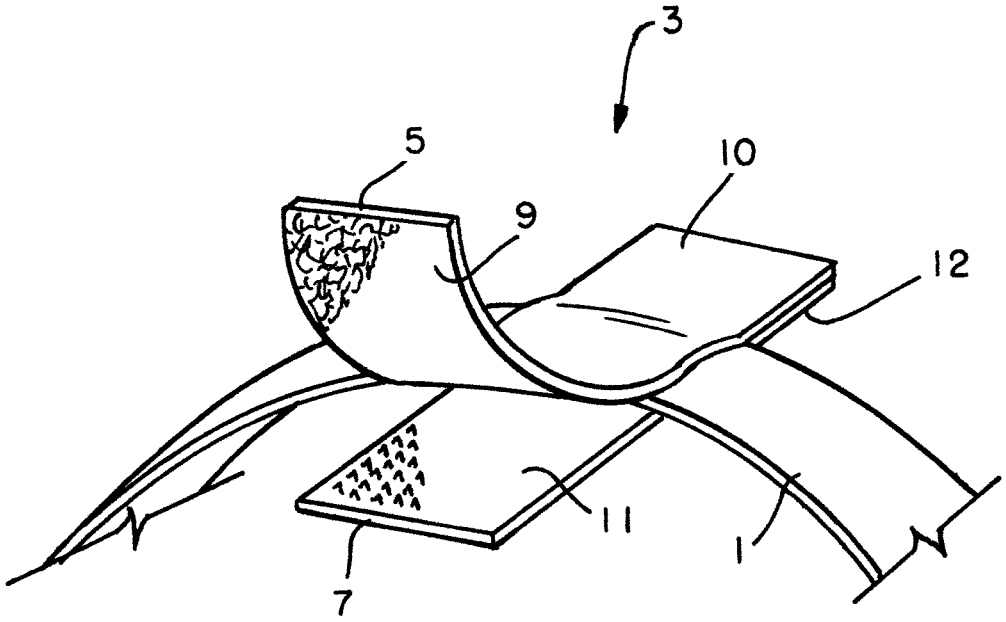

FIG. 1 shows one representative version of the invention. A band 1, to be worn by a user of the two-layer corsage sleeve 3 (note: reference number 3, associated with an arrow directed toward the two-layer sleeve, refers to the two-layer sleeve as a whole), is inserted between the sleeve's first layer 5 and second layer 7. In FIG. 1 the band 1 and sleeve 3 are shown such that a portion of each of the two layers of the sleeve are not yet mechanically engaged with each other (in order to show detail of the band interposed between the two layers of the sleeve). First layer 5 comprises a first surface 9 and a second, opposing surface 10. Second layer 7 comprises a first surface 11 and a second, opposing surface 12. It should also be recognized that the drawing is for illustrative purposes, and is not drawn to scale (as is true for all drawings in the present application). The first surface 9 of the first layer 5 includes mechanical structures configured to releasably engage mechanical structures located on the first surface 11 of the second layer 7. For example, the first surface 9 of the first layer 5 may comprise a plurality of loop-like structures configured to engage a plurality of hook-like structures on the first surface 11 of the second layer 7. In FIG. 1, a portion of first surface 9 of first layer 5 is drawn to show loop-like structures; and a portion of first surface 11 of second layer 7 is drawn to show hook-like structures. Note, however, that in other versions of the invention first surface 9 of the first layer 5 may comprise a plurality of hook-like structures configured to engage a plurality of loop-like structures on the first surface 11 of the second layer 7. Or one or both layers may comprise a plurality of mushroom-like structures (i.e., a series of stems protruding from the first surface of one or both of first layer 5 and second layer 7, with each stem terminating in a cap—the cap and stem resembling a mushroom). The mushroom-like structures are configured to releasably engage other mushroom-like structures, loop-like structures, or hook-like structures. Other structures may be used, so long as portions of the first surfaces of each of the two layers of the sleeve are configured to releasably engage each other. Typically a conventional Velcro®-brand-like or other brand hook-and-loop-type material is used.

Before providing additional detail regarding the two-layer corsage sleeve, it should be noted that some versions of the invention include both a band and a two-layer corsage sleeve. Other versions of the invention comprise the two-layer corsage sleeve alone (with, for example, a user of the inventive sleeve attaching the sleeve to a bracelet or other item that the user provides).

Band 1 can assume a wide variety of configurations (representative versions of the band are shown in FIGS. 2A, 2B, 2C, 2D, 2E, and 2F; it should be understood that these figures are illustrative of the many different bands, bracelets, ribbons, strands, bangles, wristlets, anklets, armlets, circlets, chokers, chains, hoops, etc. that the two-layer sleeve may be deployed with). For example, band 1 may be a single, continuous, curvilinear structure with a substantially circular, oval-like, rectangular-like, ellipsoid-like, or other such cross section (see, e.g., FIG. 2D). The band may be substantially rigid or flexible.

Band 1 may be a closed loop-like structure (see, e.g., FIG. 2A, 2B, 2D, or 2F), in which case a user of the band must pass a portion of his or her body (typically a hand or foot) through the band's opening so that the band may be worn by the user (e.g., on a wrist or ankle). Or band 1 may be of a finite length with a gap between opposing ends of the band (see, e.g., FIG. 2C), in which a case a user may slip a portion of his or her body through the gap so that the band may be worn by the user. Also, in those versions in which the band is of a finite length, the opposing ends of the band may terminate in a band fastening component configured to attach one end of the band to the opposing end of the band (see, e.g., FIG. 2E, in which the opposing ends of the bracelet may terminate in a clasp—the clasp is not shown in the figure). Examples of such band fasteners include clasps, buckles, double-D-ring fasteners, hook-and-loop fasteners, and the like. Any type of band fastener may be used so long as the band, once fastened, remains reasonably securely on the body of the wearer.

Figure 2A:
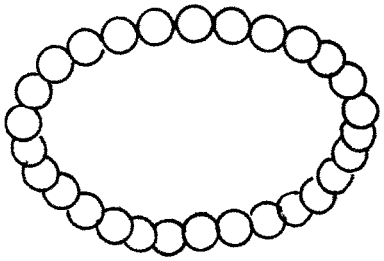
Figure 2B:
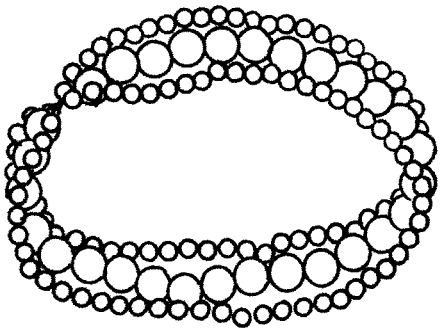
Figure 2C:
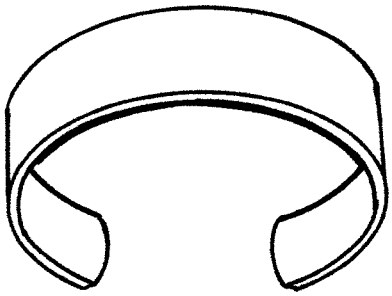
Figure 2D:
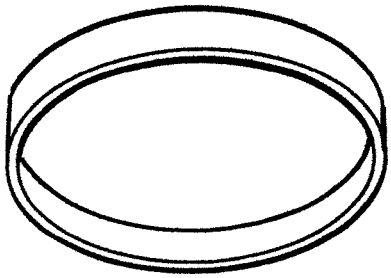
Figure 2E:
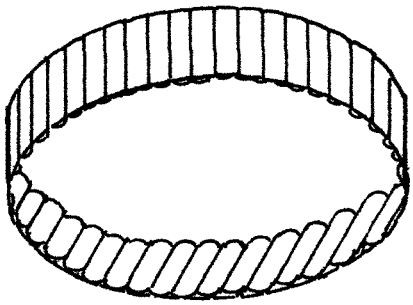
Figure 2F:
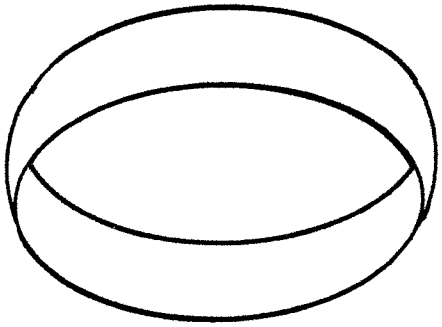

Band 1 may comprise a plurality of strands or loops (see, e.g., FIG. 2B; with each of the individual strands or loops substantially parallel to one another; or with the individual strands or loops interwoven with one another). It should also be noted that band 1 may comprise a plurality of individual links that are connected to each other; beads that are linked to one other, or which include an opening through which a thread or strand is passed through; or other such band in which a plurality of individual links, charms, beads, pearls, gems, etc. are interconnected to one another.

Band 1 may be made of a variety of materials, including metal, wood, plastic, fabric, elastomeric materials, woven materials, nonwoven materials, etc., and various combinations thereof. Any material, or combination of materials, may be used, so long as the band may be attached to the two-layer corsage sleeve as described herein.

It should also be noted that in some versions of the invention band 1 may be configured to assume both a laid-flat position or orientation as well as a curvilinear position or orientation.

Virtually any band or substrate may be used in conjunction with the two-layer corsage sleeve, in part because my inventive sleeve provides the capability of varying the area of contact/mechanical engagement between the two layers of the sleeve, thus simultaneously providing the capability of varying the shape and size of the opening between the two layers through which the band passes (and within which a portion of the band is enveloped and confined by the mechanically engaged layers of the two-layer sleeve). It should be noted, too, that for those versions of the band that include a plurality of strands or stacked bands, the two-layer sleeve may close around, and envelope, all of the available strands or stacked bands, or some portion thereof.

Sleeve 3, as noted above, is typically made of plastic, such as nylon, polyester, vinyl, polyethylene, polypropylene, or other suitable polymer. The sleeve may be in the form of a fabric, woven, nonwoven, or other such structure. Each of the two layers of the sleeve may comprise multiple components. For example a sleeve may comprise a woven or nonwoven fabric backing to which is attached one of the two materials that compose the releasably engageable surfaces of the two layers of the sleeve. Thus, in one version of the invention, the first layer of the sleeve may comprise a fabric to which is sewn, fused, adhesively bonded, or otherwise attached a layer of loop-like structures—the result of which is the first surface of the first layer comprising a plurality of loop-like structures—with the opposing surface of the first layer comprising the exposed surface of the fabric backing. The second layer of the sleeve may then comprise a fabric to which is sewn, fused, adhesively bonded, or otherwise attached a layer of hook-like structures—the result of which is the first surface of the second layer comprising a plurality of hook-like structures—with the opposing surface of the second layer comprising the exposed surface of the fabric backing. Any combination of components and materials may be used to form the two-layer corsage sleeve, so long as portions of the first surfaces of the two layers of the sleeve are configured to releasably engage one another such that the engaged layers of the sleeve are capable of enveloping and confining a portion of a band or substrate.

It should be noted that the number of individual loops, hooks, mushrooms, etc. per unit area of material may be varied to obtain different bonding or gripping strengths between the two layers. Furthermore, the lengths of the individual elements (e.g., the length of a hook, mushroom, or loop protruding outwardly from a backing) may be varied. Also, the dimensions of the sleeve may be varied to increase or decrease the area of contact between the two layers after they are mechanically engaged (with the substrate interposed between, and confined by, said engaged layers). A wide variety of such conventional releasably engageable materials may be used with the present invention and are available from a number of companies including, for example, 3M, a business having offices in St. Paul, Minnesota; and Velcro USA Inc., a business having offices in Manchester, New Hampshire. Of course other materials may be chosen and used in versions of the present invention.

Figure 3A:
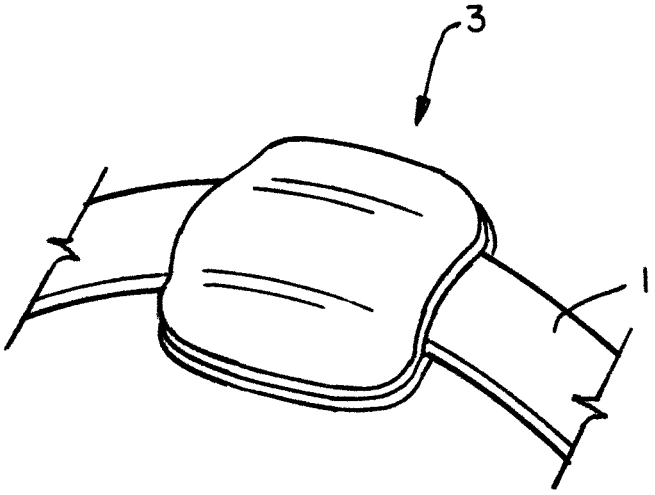
FIG. 3A shows one representative version of the invention.
Figure 3B:
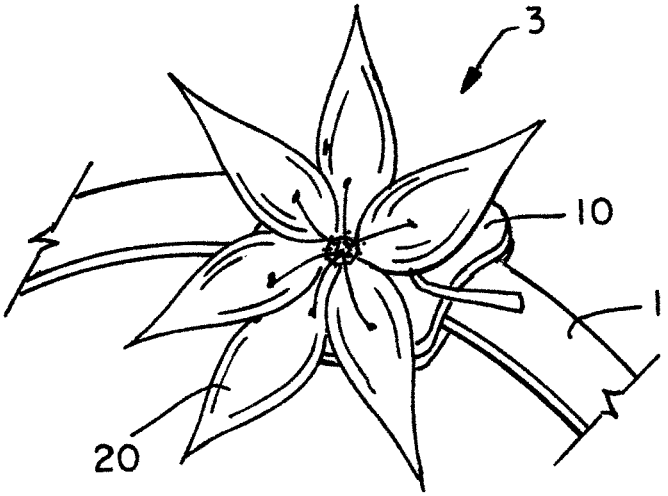
FIG. 3B shows one representative version of the invention.

FIGS. 3A and 3B depict sleeve 3 such that it envelops, and is attached to, band 1. FIG. 3A shows the two-layer sleeve without an ornamental decoration, such as a flower (or flower arrangement), attached to said sleeve. As noted elsewhere, the shape of the sleeve may assume any one of a number of simple geometric configurations, including an oval, ellipse, circle, parallelogram, star, chevron, etc. Alternatively, the shape of the sleeve may be cut to represent a plant, or a part of a plant, such as the petal of a flower, a leaf, etc.; an animal; an animated figure; etc. The sleeve can assume any shape, so long as the two layers of the sleeve are capable of releasably engaging each other with a portion of the band interposed between and confined by said layers (and, as noted elsewhere, to remain reasonably securely attached during use).

It should be noted, also, that a portion of the two-layer sleeve may be manufactured, printed, or both so that the sleeve includes one or more colors, logos and/or trademarks of a business, recognizable objects (e.g., the appearance of a smartwatch), flowers, plants, animals, famous personalities, animated figures, etc.). If desired, the color or print pattern may be selected to correspond to the shape of the two-layer sleeve. For example, if the perimeter of the sleeve defines the shape of a leaf, then the sleeve may be printed or manufactured to include the color green. Furthermore, additional features of a leaf could be disposed on the surface of the leaf (e.g., the two-layer sleeve could assume the shape of a leaf, with the sleeve being made or printed so that the sleeve was green—and also printed to show the details of the veins of a leaf). Or, alternatively, if the sleeve is cut in the form of a rounded rectangle, the shape of which corresponded to a smart watch, then the sleeve could be printed to depict a pattern resembling the face of a smart watch. Any such combination of sleeve shape, sleeve color, and/or a print pattern on the sleeve may be used, so long as portions of the first surface of the two layers of the sleeve are capable of releasably engaging each other with a portion of the band interposed between and confined by said layers.

Figure 4B:
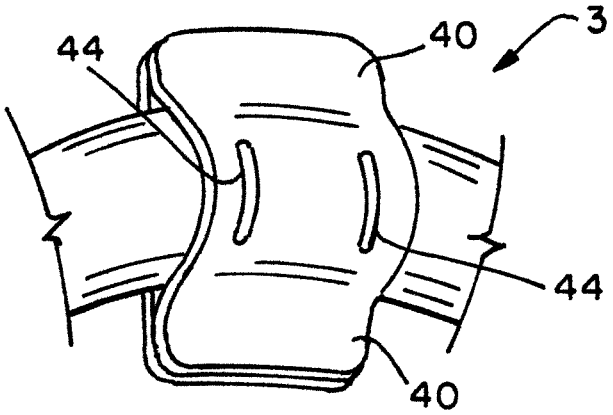
Figure 4C:
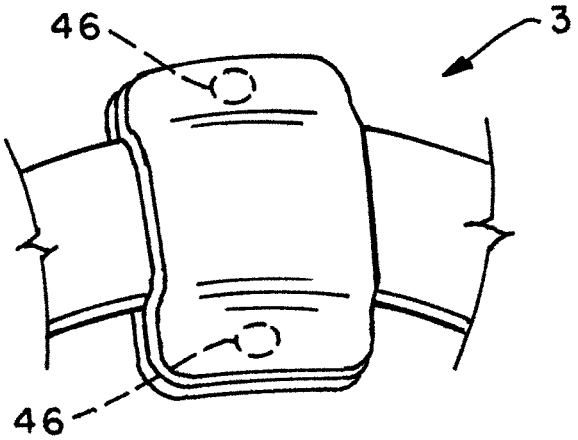

The version of the invention depicted in FIG. 3A does not include openings in the sleeve, said openings configured to receive, for example, wire used to affix an ornamental decoration to the sleeve (e.g., by wrapping wire around a portion of the ornamental decoration, thereby attaching said wire to the decoration, and passing a portion of said wire through the openings such that the wire interconnects the ornamental decoration to the sleeve). As noted elsewhere, however, in some versions of the invention the two-layer sleeve includes one or more such openings. FIGS. 4A, 4B, and 4C, described in more detail below, depict representative versions of the invention with holes, slits, magnets, metal, etc.

FIG. 3B shows the same band and sleeve as in FIG. 3A, with the exception that a flower 20 is attached to the second, opposing surface 10 of the first layer of the two-layer sleeve 3. As noted elsewhere in the present application, an ornamental decoration—such as natural or artificial flowers, may be attached to the two-layer sleeve using a conventional fastener or fastening component (denominated as a sleeve fastener, which is used here to denote the direct or indirect connection or attachment between an ornamental decoration and the two-layer sleeve) such as, for example, wire, string, adhesive, a magnetic fastener, a hook-and-loop fastener, tape, or any such fastener, material, or mechanical device used to attach or affix one object to another.

As described above, the two-layer sleeve may incorporate openings configured to receive wire or string so that the wire or string may be tied or otherwise affixed to the two-layer sleeve, thereby interconnecting the ornamental decoration, such as a natural or artificial flower, or flowers, to the sleeve.

FIGS. 4A and 4B, for example, depict versions of the inventive two-layer sleeve in which circular openings 42 (see FIG. 4A) or rectangular slit-like openings 44 (see FIG. 4B) are present in portions of the two-layer sleeve. These openings are configured to receive wire, ribbon, thread, strand, string, tape, or other such material such that the material is passed through said openings, thereby permitting tying, binding, or otherwise attaching an ornamental decoration to the two-layer sleeve. The openings may be of any shape, size, or number; and may be present and positioned in one or both layers of the two-layer sleeve, so long as the two-layer sleeve is capable of enveloping, and confining, a portion of a band to which the sleeve is attached.

It should be noted that the dimensions of the two-layer sleeve may be varied in order to effect a flange-like extension 40 (see FIG. 4B for a depiction of one version of a flanged-like extension)—with the flange-like extension approximately corresponding to those portions of the first and second layer that are releasably engaged to one another on either side of the substrate (e.g., a band) that is sandwiched between the two engaged layers. The size of this area of contact may be varied to accommodate, for example, holes, slits, magnets, metal, or the like.

In another version of the invention, magnets or other material (e.g., metal) configured to permit magnetic attraction and attachment between the two-layer sleeve and an ornamental decoration is embedded or attached to the two-layer sleeve. For example, in FIG. 4C, magnets 46 are embedded in the first layer of the two-layer sleeve (e.g., between a loop-like material adhesively attached to a fabric backing). Of course said magnets or metal need not be embedded in a portion of the two-layer sleeve. Instead, magnets or metal may be attached to a surface of the two-layer sleeve (e.g., by adhesively attaching said magnets or metal to the second surface of the first layer of the two-layer sleeve; the second surface being the opposing, exposed surface of the first layer of the two-layer sleeve). The magnets or metal may be of different sizes and shapes, and may be located at different positions on or in one or both layers of the two-layer sleeve.

Of course a magnetic attachment between the two-layer sleeve and an ornamental decoration requires that some portion of the ornamental decoration include a metal, a magnet, or other such material configured to magnetically attach to a metal, magnet, or other such material embedded in, or attached to, the two-layer sleeve. Accordingly, for those versions of the invention in which the two-layer sleeve is configured to magnetically attach to an ornamental decoration, the ornamental decoration also includes a metal, magnet, or other such material capable of magnetic attraction. Said metal, magnet, or other such material may be attached directly to the ornamental decoration (e.g., via an adhesive composition used to adhesively attach the magnet, metal, or other such material directly to the stems of flowers) or indirectly to the flowers (e.g., via an adhesive composition used to adhesively attach the magnet, metal, or other such material to a bulb, tube, vase, or other such container into which the stems of flowers are inserted; via an adhesive composition used to adhesively attach the magnet, metal, or other such material to tape used to wrap around, gather, and bind together the stems of flowers; directly to a metal container such as a tussy-mussy vase; etc.).

Alternatively, the ornamental decoration (e.g., natural or artificial flowers) may be adhered directly or indirectly to the two-layer sleeve using an adhesive composition. As discussed above when describing magnetic attachment between the two-layer sleeve and an ornamental decoration, the cut stems of natural flowers may be inserted into a glass, metal, or plastic bulb, tube, vase, or other container, typically containing water and, optionally, other ingredients or nutrients (unless of course the ornamental decoration is artificial). The tube, container, vase, or other container may then be adhesively attached to a portion of the two-layer sleeve. Or the ornamental decoration can be adhered directly to the two-layer sleeve using an adhesive composition.

Figure 5B:
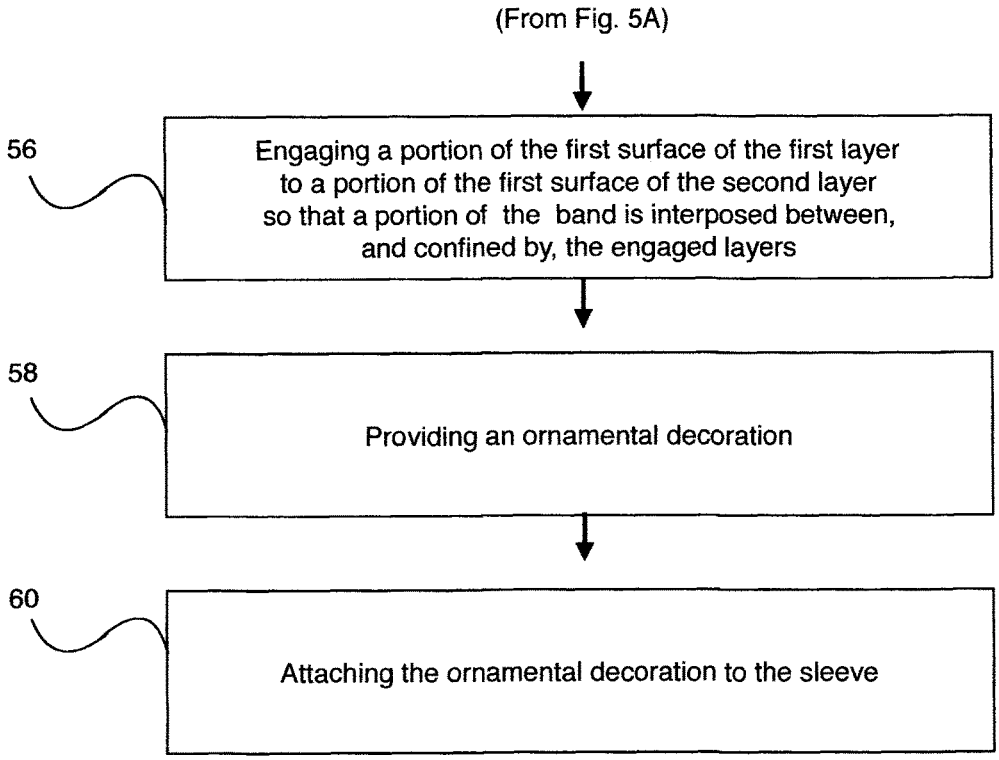

FIGS. 5A and 5B show one representative version of a method of the present invention. The depicted version includes the steps of: step 50—providing a two-layer sleeve configured to attach an ornamental decoration to a band, the band configured to be worn by a user, the two-layer sleeve comprising a first layer having a first surface and a second, opposing surface; and a second layer having a first surface and a second, opposing surface, a portion of the first surface of the first layer configured to releasably engage a portion of the first surface of the second layer, the band configured to be worn by a user; step 52—providing the band configured to be worn by a user; step 54—positioning a portion of the band between the first surface of the first layer and the first surface of the second layer; step 56—engaging a portion of the first surface of the first layer to a portion of the first surface of the second layer so that a portion of the band is interposed between, and confined by, the engaged layers; step 58—providing an ornamental decoration; step 60—attaching the ornamental decoration to the sleeve.

It should be noted that methods of the present invention are not restricted to the depicted steps, nor are these inventive methods restricted to the sequential order of the depicted steps.

For example, one method of the present invention comprises steps analogous to steps 54 and 56 (with additions to the steps that follow because this abbreviated method comprising analogues to steps 54 and 56 does not have the antecedent claim elements included in steps 50 and 52): step 54—positioning a portion of a band between a first surface of a first layer and a first surface of a second layer of a two-layer sleeve, the two-layer sleeve comprising both the first layer and the second layer, the first layer comprising the first surface configured to releasably engage the first surface of the second layer; step 56—engaging the first surface of the first layer to the first surface of the second layer so that the band is interposed between, and confined by, the engaged layers.

Another method of the present invention comprises steps 54 and 56 as described in the preceding paragraph, and adds step 60—attaching an ornamental decoration to the sleeve.

In other representative methods of the present invention, step 60, describing the step of attaching or fastening an ornamental decoration to the sleeve (e.g., as described elsewhere in the present application, by fastening magnetically, adhesively, mechanically—as with a wire, ribbon, or thread, etc.; or any other fastener), may be carried out before the two-layer sleeve is attached to the band (here the word "attach" denotes the positioning of the band between the two sleeves, then engaging the two layers so that a portion of the band is interposed between, and confined by, the engaged layers). Thus, for example, an ornamental decoration is first attached to the second, opposing surface of the first layer of the two-layer sleeve (e.g., using an adhesive composition). A substrate such as a band is then positioned between the first and second layers before engaging the first layer to the second layer so that the substrate is interposed between, and confined by, the engaged layers.

Another representative method of the present invention includes steps 50 and 52. That is, one method of the present invention comprises the steps of providing a two-layer sleeve configured to attach an ornamental decoration to a band, and the step of providing the band itself.

Another representative method of the present invention comprises steps 50, 52, and 58, in which case, in addition to steps 50 and 52 described above, the method also includes the step of providing an ornamental decoration. Other methods and method sequences are possible, so long as the inventive two-layer sleeve, as described in the present application, is provided, made available, deployed, made, or used.

As described elsewhere in the present application, the two-layer sleeve that is provided in accordance with a method of the present invention may assume a variety of shapes, colors, thicknesses, print patterns, etc. Furthermore, the two-layer sleeve may include additional components configured to facilitate attachment of an ornamental decoration to the sleeve. Thus, for example, in step 50, that which is provided is a two-layer sleeve configured to attach an ornamental decoration to a band, the two-layer sleeve comprising a first layer having a first surface and a second, opposing surface; and a second layer having a first surface and a second, opposing surface—the first surface of the first layer configured to releasably engage the first surface of the second layer, with the two-layer sleeve further comprising openings configured to receive wire, string, thread or other such flexible strand used to attach an ornamental decoration to the two-layer sleeve.

For such a sleeve, step 50 can specifically recite attaching an ornamental decoration to the sleeve by attaching a wire, string, thread, or other flexible strand to the ornamental decoration (either directly, by, for example, wrapping or passing the wire, string, thread, or other flexible strand around, through, or intertwined with portions of the ornamental decoration; or, indirectly, by, for example, passing the wire, string, thread, or other flexible strand around, through, or intertwined with a component attached to the ornamental decoration—for example a bulb or tube into which is inserted the stem or stems of flowers). Also, a method of the present invention can recite an additional step of providing the wire, string, thread, or other flexible strand configured to attach an ornamental decoration to the two-layers sleeve.

Alternatively, in step 50, that which is provided is a two-layer sleeve configured to attach an ornamental decoration to a band, the two-layer sleeve comprising a first layer having a first surface and a second layer having a first surface—the first surface of the first layer configured to releasably engage the first surface of the second layer, with the two-layer sleeve further comprising components for attaching the ornamental decoration to the sleeve magnetically. That is, the sleeve includes, for example, a first magnet, metal, or other such material adhered to, attached to, embedded in, or forming a part of a layer of the two-layer sleeve—the magnet, metal, or other such material configured to magnetically attract a second magnet, metal, or other material attached to an ornamental decoration (either directly—with, for example, the second magnet, metal, or other such material adhered to the ornamental decoration; or indirectly—with, for example, the second magnet, metal, or other such material adhered to a bulb or tube into which is inserted the stem or stems of an ornamental decoration). For such a sleeve, and for those versions of a method of the present invention that include step 60 in addition to step 50, step 60 can specifically recite attaching an ornamental decoration to the sleeve magnetically.

As described elsewhere, a two-layer sleeve of the present invention may be attached to an ornamental decoration in other ways. Thus, for example, one or more pins may be inserted through a portion of the ornamental decoration and a portion of the two-layer sleeve, thereby attaching the ornamental decoration to the sleeve. In such cases, the two-layer sleeve need not include openings nor a magnet, metal, or other material configured to magnetically attach the sleeve to the ornamental decoration (though, of course, the sleeve could include openings, an electromagnetic component, or both, thus enabling a user to choose the manner of attachment between the ornamental decoration and the two-layer sleeve).

Alternatively, an ornamental decoration can be adhered to the two-layer sleeve—either directly or indirectly—using an adhesive composition, an adhesive substrate, or other such component. The word "directly" denotes the ornamental decoration being attached to the ornamental sleeve without an intermediate component interposed between the decoration and the sleeve (e.g., an adhesive composition is applied directly to a portion of the ornamental decoration, with the treated portion of the ornamental decoration then being pressed directly to the sleeve, thereby adhesively attaching the ornamental decoration to the sleeve; alternatively, an adhesive composition may be applied to the sleeve, with the ornamental decoration then be pressed against that portion of the sleeve to which the adhesive composition had been applied; or the adhesive composition can be applied to both the ornamental decoration and the sleeve, with the ornamental decoration and sleeve being pressed against one other at the locations to which the adhesive composition had been applied). The word "indirectly" denotes the ornamental decoration being attached to some intermediate component (e.g., the stem or stems of flowers inserted into a tube, bulb, vase, or other container—with the tube, bulb, vase, or other container now constituting an intermediate component). It should be noted, then, that methods of the present invention encompass a variety of steps and components by which an ornamental decoration may be attached to the two-layer sleeve and, ultimately, to a user/wearer of the two-layer sleeve and the substrate to which the sleeve is attached.

Example 1

Velcro-brand hook-and-loop tape, available from Velcro USA Inc., a business having offices in Manchester, New Hampshire, was obtained. The tape was about 5.1 centimeters wide, with an approximate thickness of 3.2 millimeters (the thickness corresponded to the thickness of both layers when the layers were engaged, i.e., both the layer with loops and the layer with hooks). The tape was cut in the shape of a rectangle having the dimensions of 5.1 cm by 3.5 cm. The tape was then separated into two components—each releasably engageable to the other—each component serving as opposing layers of the two-layer sleeve of the present invention. That is, that component of the procured tape corresponding to a layer comprised of a plurality of loops extending from one surface served a the first layer of the two-layer sleeve. The component of the procured tape corresponding to the layer comprised of hooks extending from the one surface served as the second layer of the two-layer sleeve. Artificial flowers were then adhesively attached to the second, opposing surface of that component of the tape comprising loops on the first surface of the first layer. After the flowers had been attached to the second, opposing surface of the first layer, the first surface of the first layer comprised of loops was positioned over a conventional band configured to be worn around the wrist of a user, with the band approximately centered under the first layer. The first surface of the second layer—i.e., the surface comprising hooks configured to releasably engage the loops of the first surface of the first layer, was then positioned directly under both the band and the first layer. The first and second layers were then pressed against each other, with a compressive force applied to those portions of the two layers of the sleeve on either side of the band, thereby mechanically engaging the sleeves such that a portion of the band was confined between the engaged layers of the two-layer sleeve.

It is to be understood that the embodiments of the invention herein described are merely illustrative of the application of the principles of the invention. Reference herein to details of the illustrated embodiments is not intended to limit the scope of the claims, which themselves recite those features regarded as essential to the invention.

I claim:

1. A two-layer corsage sleeve configured to indirectly attach an ornamental flower to a band, the band configured to be worn on a wrist of a user, the two-layer corsage sleeve comprising:

a first layer having a first surface and a second, opposing surface;

a second layer having a first surface and a second, opposing surface, wherein a portion of the first surface of the second layer is configured to releasably engage a portion of the first surface of the first layer, wherein the first surface of the first layer comprises a plurality of loops and wherein the first surface of the second layer comprises a plurality of hooks;

wherein the first layer and second layer of the two-layer corsage sleeve are configured to interpose and confine a portion of the band, the band to be worn on the wrist of the user, between the engaged first and second layers; and a sleeve fastener configured to attach the ornamental flower to the two-layer corsage sleeve without any direct attachment of the ornamental flower to the band;

wherein the sleeve fastener is an opening in one or both of the first layer and the second layer; a magnet attached to or embedded in one or both of the first layer and the second layer; a metal attached to or embedded in one or both of the first layer and the second layer; an adhesive; a pin; a wire; a thread; a ribbon; or some combination thereof.

2. A kit comprising the two-layer corsage sleeve of claim 1 and the band configured to be worn on the wrist of the user.

3. The kit of claim 2 further comprising the ornamental flower.

4. A method for indirectly attaching an ornamental flower to a band, the band configured to be worn by a user, the method comprising the steps of:

providing a two-layer corsage sleeve configured to indirectly attach an ornamental flower to a band, the band configured to be worn by a user, the two-layer corsage sleeve comprising:

a first layer having a first surface and a second, opposing surface;

a second layer having a first surface, and a second, opposing surface, wherein a portion of the first surface of the first layer is configured to releasably engage a portion of the first surface of the second layer, and wherein the first surface of the first layer comprises a plurality of mechanical structures, and wherein the first surface of the second layer comprises a plurality of mechanical structures such that the mechanical structures on the first surface of the first layer are configured to releasably engage the mechanical structures on the first surface of the second layer; and wherein the first and second layers are configured to interpose and confine a portion of the band between said first and second layers, the band to be worn by the user; and a sleeve fastener configured to attach the ornamental flower to the two-layer corsage sleeve without any direct attachment of the ornamental flower to the band;

positioning a portion of the band between the first surface of the first layer and the first surface of the second layer;

releasably engaging a portion of the mechanical structures on the first surface of the first layer to a portion of the mechanical structures on the first surface of the second layer;

wherein a portion of the band is interposed between, and confined by, the first surface of the first layer and the first surface of the second layer; and attaching the ornamental flower to the sleeve fastener of the two-layer corsage sleeve without any direct attachment of the ornamental flower to the band.

5. The method of claim 4 wherein the mechanical structures on the first surface of the first layer are a plurality of loops, and wherein the mechanical structures on the first surface of the second layer are a plurality of hooks.

6. The method of claim 5 further comprising the step of providing the band configured to be worn by the user.

7. A method of attaching an ornamental flower to a user, the method comprising the steps of:

positioning a portion of a band, the band configured to be worn by the user, between a first surface of a first layer and a first surface of a second layer of a two-layer corsage sleeve comprising a sleeve fastener, the two-layer corsage sleeve configured to indirectly attach an ornamental flower to the band;

wherein the first surface of the first layer comprises a plurality of mechanical structures, and wherein the first surface of the second layer comprises a plurality of mechanical structures such that the mechanical structures on the first surface of the first layer are configured to releasably engage the mechanical structures on the first surface of the second layer;

releasably engaging a portion of the mechanical structures on the first surface of the first layer to a portion of the mechanical structures on the first surface of the second layer so that the band is interposed between, and confined by, the releasably engaged first and second layers;

passing a portion of the body of the user through the band or a gap in the band or fastening the band on the body of the user so that the band is worn by the user;

attaching the ornamental flower to the sleeve fastener of the two-layer corsage sleeve without directly attaching the ornamental flower to the band.

8. The method of claim 7 wherein the mechanical structures on the first surface of the first layer are a plurality of loops and the mechanical structures on the first surface of the second layer are a plurality of hooks.

9. The method of claim 8 wherein the ornamental flower is not pinned to the band.

10. The method of claim 8 wherein the ornamental flower is not adhesively attached to the band.

11. The method of claim 8 wherein the band is not defaced or marred by attachment of the ornamental flower to the two-layer corsage sleeve.

* * * * *